US010514187B2

(12) United States Patent
Uselton

(10) Patent No.: US 10,514,187 B2
(45) Date of Patent: Dec. 24, 2019

(54) REVERSIBLE HEAT PUMP WITH CYCLE ENHANCEMENTS

(71) Applicant: Lennox Industries Inc., Richardson, TX (US)

(72) Inventor: Robert B. Uselton, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 155 days.

(21) Appl. No.: 15/722,190

(22) Filed: Oct. 2, 2017

(65) Prior Publication Data

US 2018/0023848 A1 Jan. 25, 2018

Related U.S. Application Data

(62) Division of application No. 14/242,846, filed on Apr. 1, 2014, now Pat. No. 9,777,950.

(51) Int. Cl.

| | |
|---|---|
| ***F25B 1/06*** | (2006.01) |
| ***F25B 13/00*** | (2006.01) |
| ***F25B 21/02*** | (2006.01) |
| ***F25B 40/00*** | (2006.01) |
| ***F25B 40/02*** | (2006.01) |
| ***F25B 9/04*** | (2006.01) |

(52) U.S. Cl.

CPC ..... *F25B 1/06* (2013.01); *F25B 13/00* (2013.01); *F25B 21/02* (2013.01); *F25B 40/00* (2013.01); *F25B 40/02* (2013.01); *F25B 9/04* (2013.01); *F25B 2313/0272* (2013.01); *F25B 2313/02741* (2013.01); *F25B 2341/0662* (2013.01); *F25B 2400/13* (2013.01); *F25B 2400/14* (2013.01)

(58) Field of Classification Search

CPC .. F25B 1/06; F25B 13/00; F25B 40/00; F25B 2313/02741; F25B 2313/0272; F25B 9/08; F25B 9/04

See application file for complete search history.

(56) References Cited

U.S. PATENT DOCUMENTS

2010/0005831 A1* 1/2010 Vaisman ..... F25B 1/10 62/470
2014/0096557 A1* 4/2014 Higashiiue ..... F25B 13/00 62/324.6

FOREIGN PATENT DOCUMENTS

WO WO213175912 11/2013

* cited by examiner

*Primary Examiner* — Elizabeth J Martin
(74) *Attorney, Agent, or Firm* — Baker Botts L.L.P.

(57) ABSTRACT

A cycle enhancement apparatus is provided. The apparatus has a first side entrance line and exit line, both connected to a first side of a refrigerant line, and a second side entrance line and exit line, both connected to a second side of the refrigerant line. One-way valves prevent flow through the first side entrance line toward the first side, through the first side exit line away from the first side, through the second side entrance line toward the second side, and through the second side exit line away from the second side. The apparatus has a cycle enhancement line. The cycle enhancement line has an entrance portion, connected to the first side entrance line and the second side entrance line, an exit portion, connected to the first side exit line and the second side exit line, and a cycle enhancement between the entrance portion and the exit portion.

8 Claims, 12 Drawing Sheets

REVERSIBLE HEAT PUMP WITH CYCLE ENHANCEMENTS

CROSS REFERENCE TO RELATED INFORMATION

This application is a divisional of U.S. application Ser. No. 14/242,846, Filed Apr. 1, 2014, now U.S. Pat. No. 9,777,950, issued Oct. 3, 2017, the contents of which are hereby incorporated herein in its entirety.

TECHNICAL FIELD

This application relates to heat pumps and, more particularly, to heat pumps with cycle enhancements.

BACKGROUND

In a heat pump, a refrigerant may flow in a cycle between two heat exchangers, typically coils. This cycle is called a vapor compression cycle. Heat pumps are often used to heat and cool a building or other structure. In such applications, one heat exchanger may be inside the structure (the "indoor heat exchanger" or "indoor coil") and the other heat exchanger may be outside the structure (the "outdoor heat exchanger" or "outdoor coil"). For heating, the refrigerant may absorb heat as it passes through the outdoor heat exchanger and release heat as it passes through the indoor heat exchanger. For air conditioning, the refrigerant may absorb heat as it passes through the indoor heat exchanger and release heat as it passes through the outdoor heat exchanger. Heat pumps can reverse the direction of refrigerant flow, to change between heating and air conditioning. A reversing valve typically controls the direction of refrigerant flow.

Carbon dioxide (CO2) is a refrigerant with several desirable qualities. Carbon dioxide is inexpensive, abundant, and not flammable. Carbon dioxide also does not cause ozone depletion. However, carbon dioxide has a relatively low critical temperature of 87.7 degrees Fahrenheit. When used as a refrigerant in building heating and air conditioning, carbon dioxide frequently goes through "transcritical cycles," flow cycles where the refrigerant exceeds critical pressure. Transcritical cycles are energy inefficient. Thus, carbon dioxide has not been commonly adopted as a refrigerant for building air conditioning and heating.

Certain devices, called cycle enhancements, can be inserted into a vapor compression cycle to improve energy efficiency. These cycle enhancements can partially compensate for some of the poor refrigerant characteristics of carbon dioxide. However, many cycle enhancements are one-way. One-way cycle enhancements function optimally only when refrigerant flows through them in a one direction. Conventionally, a reversible heat pump optimally benefits from one-way cycle enhancements in only one direction of refrigerant flow. One-way cycle enhancements may operate less efficiently, or may not operate at all, or may impede operation during the mode which has a reverse direction of refrigerant flow.

It would be desirable if a heat pump could fully benefit from one-way cycle enhancements regardless of the direction of refrigerant flow so as to benefit both the heating and cooling modes. Such a heat pump could lead to the adoption of carbon dioxide as a refrigerant in building air conditioning and heating.

SUMMARY

In an embodiment, a cycle enhancement apparatus is provided. The apparatus has a first side entrance line, a first side exit line, a second side entrance line, a second side exit line, and a cycle enhancement line. The first side entrance line and the first side exit line are connected to a first side of a refrigerant line. The second side entrance line and the second side exit line are connected to a second side of the refrigerant line. The first side entrance line has a one-way valve preventing flow toward the first side of the refrigerant line. The first side exit line has a one-way valve preventing flow away from the first side of the refrigerant line. The second side entrance line has a one-way valve preventing flow toward the second side of the refrigerant line. The second side exit line has a one-way valve preventing flow away from the second side of the refrigerant line. The cycle enhancement line has an entrance portion connected to the first side entrance line and the second side entrance line. The cycle enhancement line has an exit portion connected to the first side exit line and the second side exit line. The cycle enhancement line has a cycle enhancement between the entrance portion and the exit portion.

DESCRIPTION OF DRAWINGS

For a more complete understanding of the present invention and the advantages thereof, reference is now made to the following Detailed Description taken in conjunction with the accompanying drawings, in which.

DETAILED DESCRIPTION

In the following discussion, numerous specific details are set forth to provide a thorough explanation. However, such specific details are not essential. In other instances, well-known elements have been illustrated in schematic or block diagram form. Additionally, for the most part, specific details within the understanding of persons of ordinary skill in the relevant art have been omitted.

Figure 1:
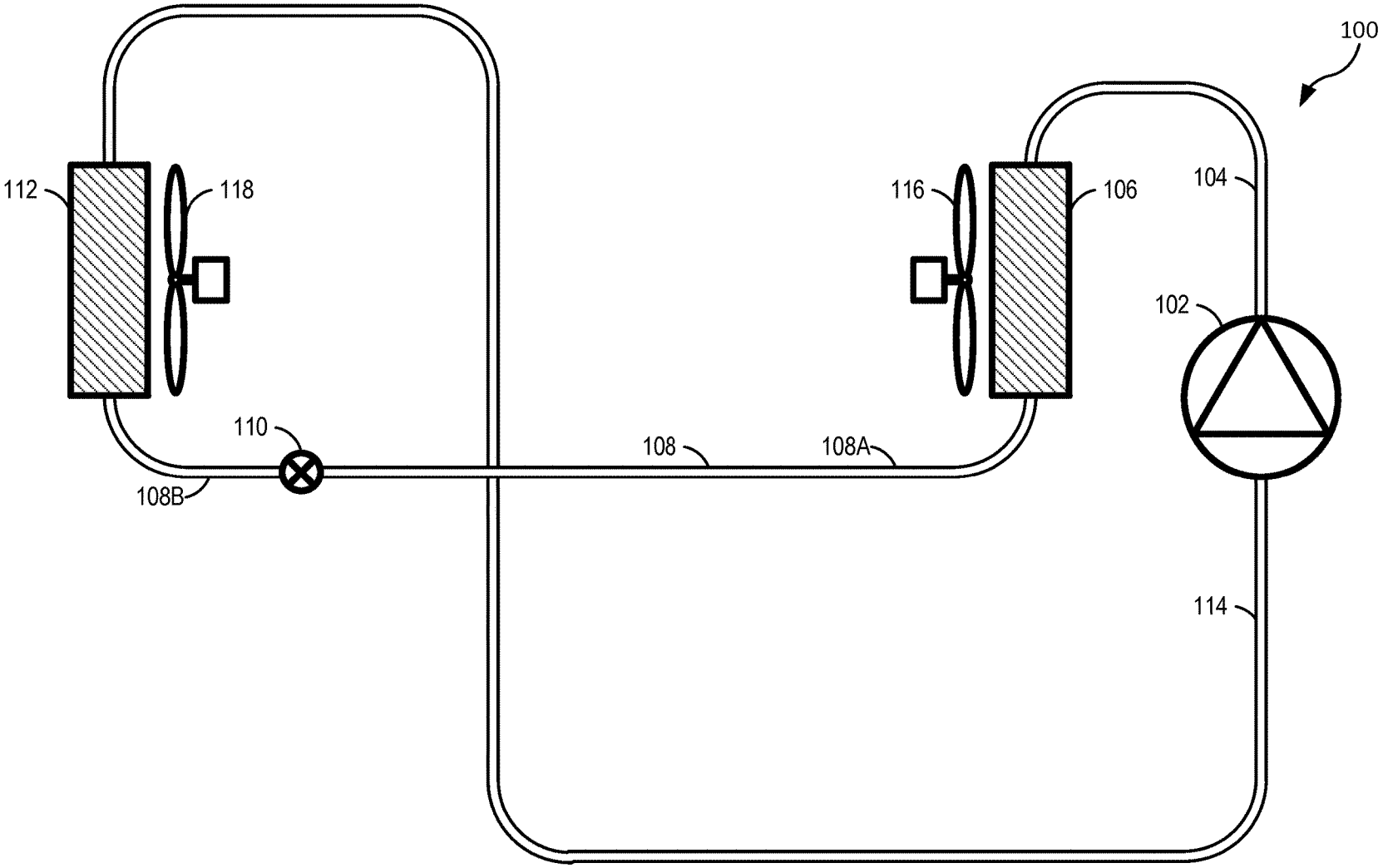
FIG. 1 PRIOR ART
FIG. 1 depicts a conventional air conditioner.

With reference to FIG. 1, depicted is a conventional air conditioner 100. Air conditioner 100 is similar to a heat pump, but is not reversible. Air conditioner 100 can only cool indoor air. Refrigerant may travel through air conditioner 100 in a vapor compression cycle. Compressor 102 may compress a refrigerant and discharge it through discharge line 104 to outdoor heat exchanger 106. As the refrigerant passes through outdoor heat exchanger 106 the refrigerant may cool, releasing heat into the outdoor environment.

The cooled refrigerant may travel through cool refrigerant line 108. Cool refrigerant line 108 may be called a "cool" refrigerant line because it may receive refrigerant which has recently had energy content reduced by rejection to a heat sink. Cool refrigerant line 108 may have two sides, outdoor side 108A and indoor side 108B. The two sides are named for the heat exchanger they are nearest, and are not necessarily located outdoors or indoors. Outdoor side 108A and indoor side 108B may be separated by expansion device 110. Expansion device 110 may be a throttle. Expansion device 110 may reduce the pressure of refrigerant passing through it, causing the refrigerant to expand. Thus, refrigerant on indoor side 108B may be at a lower pressure than refrigerant on outdoor side 108A. Cool refrigerant line 108 may be cooled by outdoor ambient air.

The lower pressure refrigerant may enter indoor heat exchanger 112. As the refrigerant passes through indoor heat exchanger 112, it may absorb heat, cooling the indoor environment. The refrigerant then may pass through suction line 114 back to compressor 102 and the vapor compression cycle may repeat.

Fan 116 may aid the exchange of heat between the refrigerant and the outdoor environment when the refrigerant passes through outdoor heat exchanger 106. Fan 118 may aid the exchange of heat between the refrigerant and the indoor environment when refrigerant passes through indoor heat exchanger 112. Heat exchangers 106 and 112 typically exchange heat with air. However, heat exchangers 106 and 112 may also exchange heat with another substance, such as water.

When in a transcritical air conditioner, outdoor heat exchanger 106 may be called a gas cooler and indoor heat exchanger 112 may be called an evaporator. The pressure of the refrigerant entering indoor heat exchanger 112 may be called the evaporator pressure. Outdoor heat exchanger 106 may be called a condenser in a conventional vapor compression cycle because it causes many refrigerants to condense into a liquid. Similarly, cool refrigerant line 108 may be called a liquid line in a conventional vapor compression cycle because many refrigerants entering it will be in liquid form. However, carbon dioxide tends to simply cool in gas vapor form, rather than condense, when it passes through outdoor heat exchanger 106. The carbon dioxide refrigerant tends to remain in gas vapor form until it passes through expansion device 110 and becomes a combination of vapor and liquid. The liquid may then evaporate when it passes through indoor heat exchanger 112.

Figure 2:
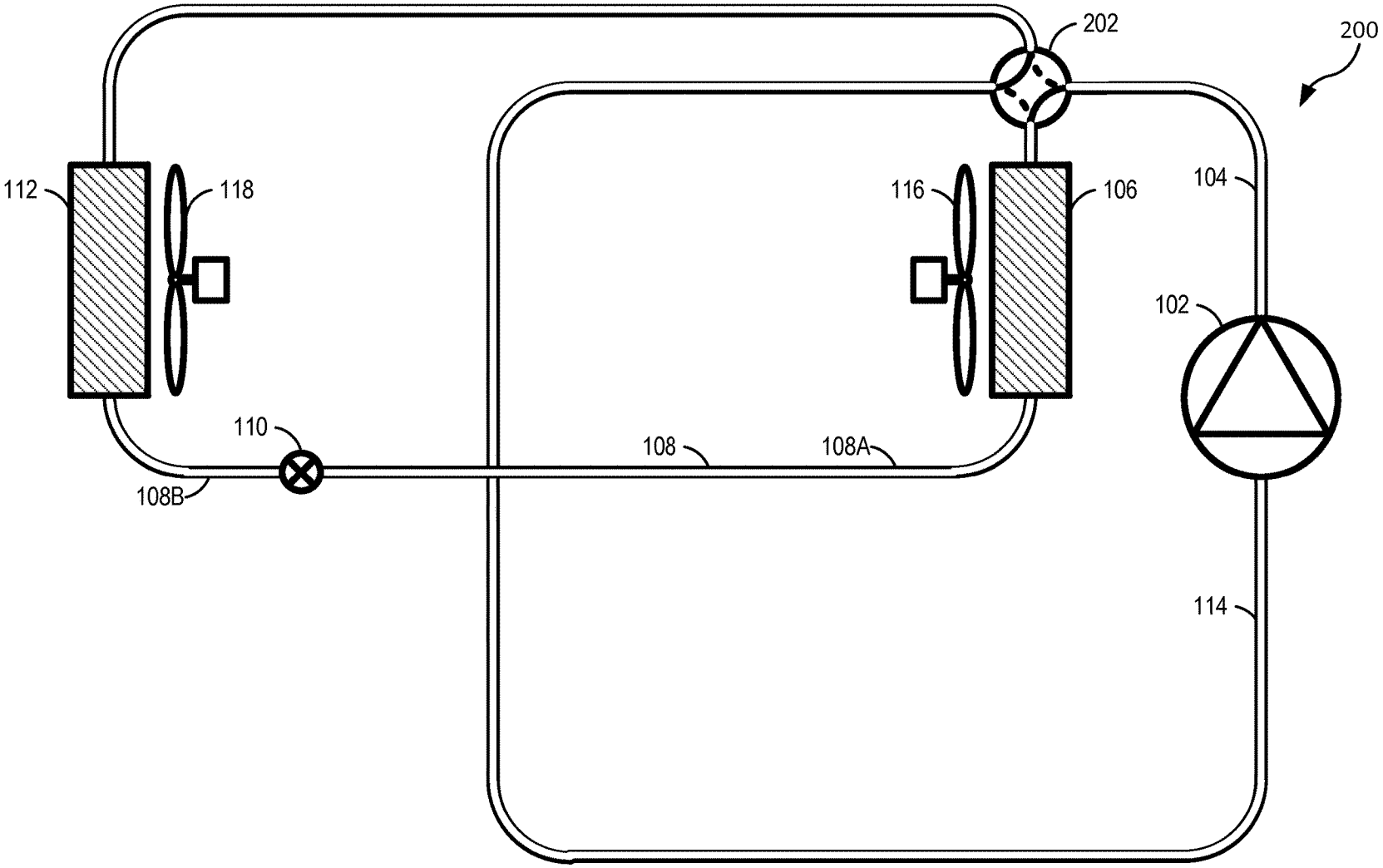
FIG. 2 PRIOR ART
FIG. 2 depicts a conventional reversible heat pump.

With reference to FIG. 2, depicted is a conventional reversible heat pump 200. Reversible heat pump 200 may have reversing device 202. Reversing device 202 may be a reversing valve. Reversing device 202 may have an air conditioning configuration, shown by solid lines, and a heating configuration, shown by dashed lines. In the air conditioning configuration, reversing device 202 may cause the refrigerant to flow identically to the refrigerant in air conditioner 100. Reversing device 202 may receive refrigerant from discharge line 104 and direct the refrigerant to outdoor heat exchanger 106. Reversing device 202 may receive refrigerant from indoor heat exchanger 112 and direct the refrigerant to suction line 114.

In the heating configuration, the vapor compression cycle may be reversed after the refrigerant leaves discharge line 104. Reversing device 202 may receive refrigerant from discharge line 104 and direct the refrigerant to indoor heat exchanger 112. As the refrigerant passes through indoor heat exchanger 112 the refrigerant may cool, releasing heat into the indoor environment. The cooled refrigerant may travel through cool refrigerant line 108 from indoor side 108B to outdoor side 108A. Expansion device 110 may reduce the pressure of the refrigerant, making the pressure on outdoor side 108A lower than the pressure on indoor side 108B.

The lower pressure refrigerant may enter outdoor heat exchanger 106. As the refrigerant passes through outdoor heat exchanger 106, it may absorb heat from the outdoor environment. Reversing device 202 may receive refrigerant from outdoor heat exchanger 106 and direct the refrigerant to suction line 114. The refrigerant may pass through suction line 114 back to compressor 102 and the vapor compression cycle may repeat.

Regardless of whether reversing device 202 is in the air conditioning configuration or the heating configuration, fan 116 may aid the exchange of heat between the refrigerant and the outdoor environment when the refrigerant passes through outdoor heat exchanger 106. Regardless of whether reversing device 202 is in the air conditioning configuration or the heating configuration, fan 118 may aid the exchange of heat between the refrigerant and the indoor environment when refrigerant passes through indoor heat exchanger 112.

When heat pump 200 is in the heating configuration, indoor heat exchanger 112 may be called a gas cooler or condenser. Outdoor heat exchanger 106 may be called an evaporator. The pressure of the refrigerant entering outdoor heat exchanger 106 may be called the evaporator pressure.

Figure 3:
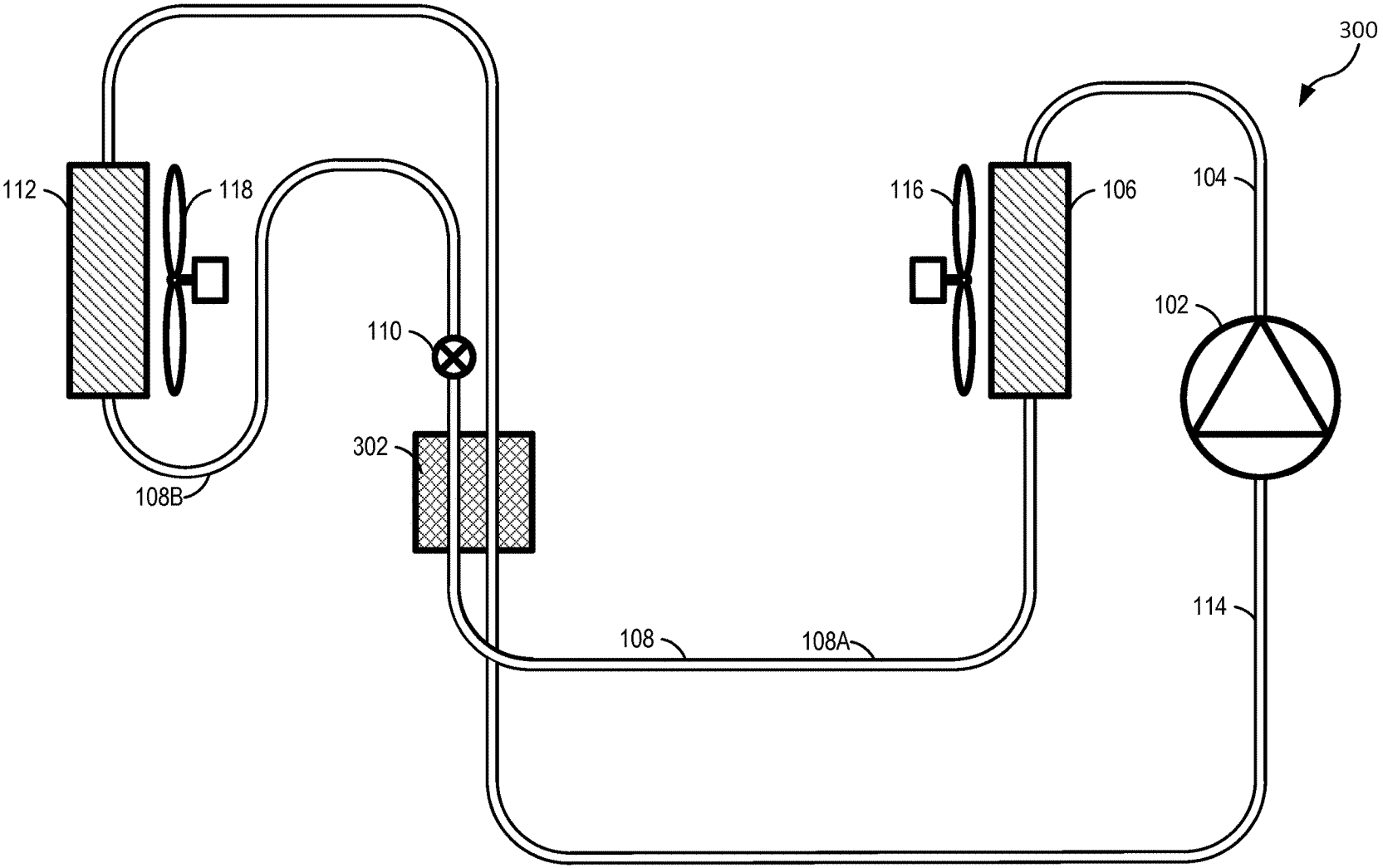
FIG. 3 PRIOR ART
FIG. 3 depicts a conventional air conditioner with a counterflow heat exchanger included.

With reference to FIG. 3, depicted is a conventional air conditioner 300. Air conditioner 300 differs from air conditioner 100 in that it includes counterflow heat exchanger 302. Counterflow heat exchanger 302 is known in the art and is an example of a one-way cycle enhancement.

Counterflow heat exchanger 302 may be a plate or coaxial tube. Outdoor side 108A of cool refrigerant line 108 may pass through counterflow heat exchanger 302. Suction line 114 may also pass through counterflow heat exchanger 302. High pressure refrigerant passing through cool refrigerant line 108 may transfer heat to low pressure refrigerant passing through suction line 114. The cooled refrigerant in cool refrigerant line 108 may be able to absorb more heat in the evaporator. Counterflow heat exchanger 302 may thereby improve the efficiency of air conditioner 300.

Although counterflow heat exchanger 302 may improve overall efficiency, the refrigerant in suction line 114 may be warmed before entering compressor 102. This warmer refrigerant may be less dense and have a slightly lower mass flow rate, reducing the pumping rate of compressor 102. The efficiency gain from the cooled refrigerant may nonetheless outweigh the reduced pumping rate of compressor 102. Counterflow heat exchanger 302 may allow air conditioner 300 to use carbon dioxide as a practical refrigerant for building air conditioning.

Figure 4:
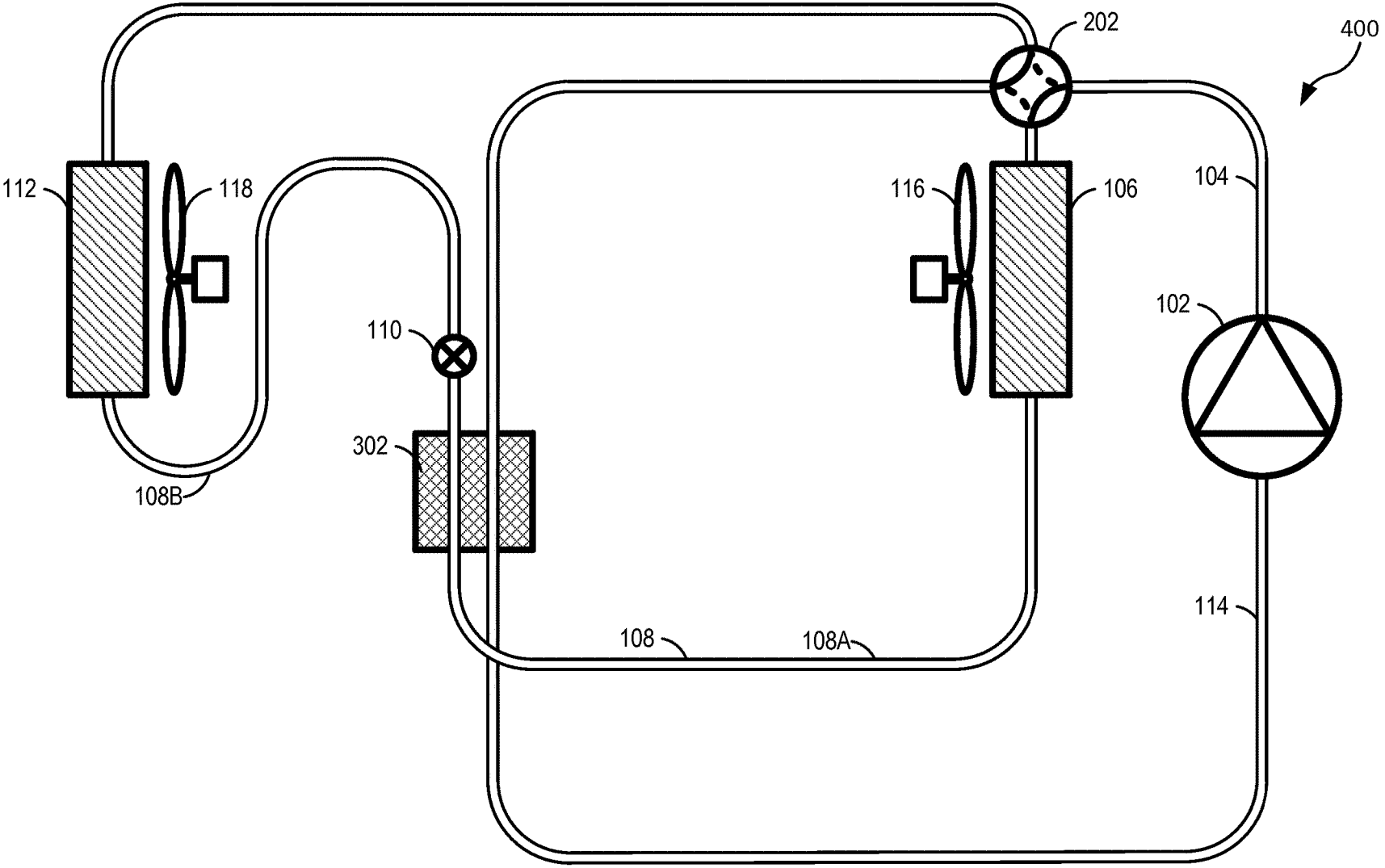
FIG. 4 depicts a reversible heat pump with a counterflow heat exchanger included.

With reference to FIG. 4, depicted is a reversible heat pump 400 with a counterflow heat exchanger 302. When reversing device 202 is in the air conditioning configuration, heat pump 400 may function identically to air conditioner 300. Due to counterflow heat exchanger 302, heat from refrigerant line 108 may transfer to suction line 114, increasing the amount of heat that can be absorbed in the evaporator.

However, when reversing device 202 is in the heating configuration, heat exchanger 302 does not function correctly; it is no longer operating in counterflow. Outdoor side 108A of cool refrigerant line 108 may still pass through heat exchanger 302. However, in the heating configuration, outdoor side 108A may be on the low pressure side of cool refrigerant line 108A. Refrigerant leaving indoor heat exchanger 112 may pass through expansion device 110 and lower in pressure and temperature before entering heat exchanger 302. Thus, both lines passing through heat exchanger 302 may contain low temperature and low pressure refrigerant. The heat transfer between suction line 114 and cool refrigerant line 108 is not advantageous to the cycle. Heat pump 400 may be unable to use carbon dioxide as a practical refrigerant for building heating.

Figure 5:
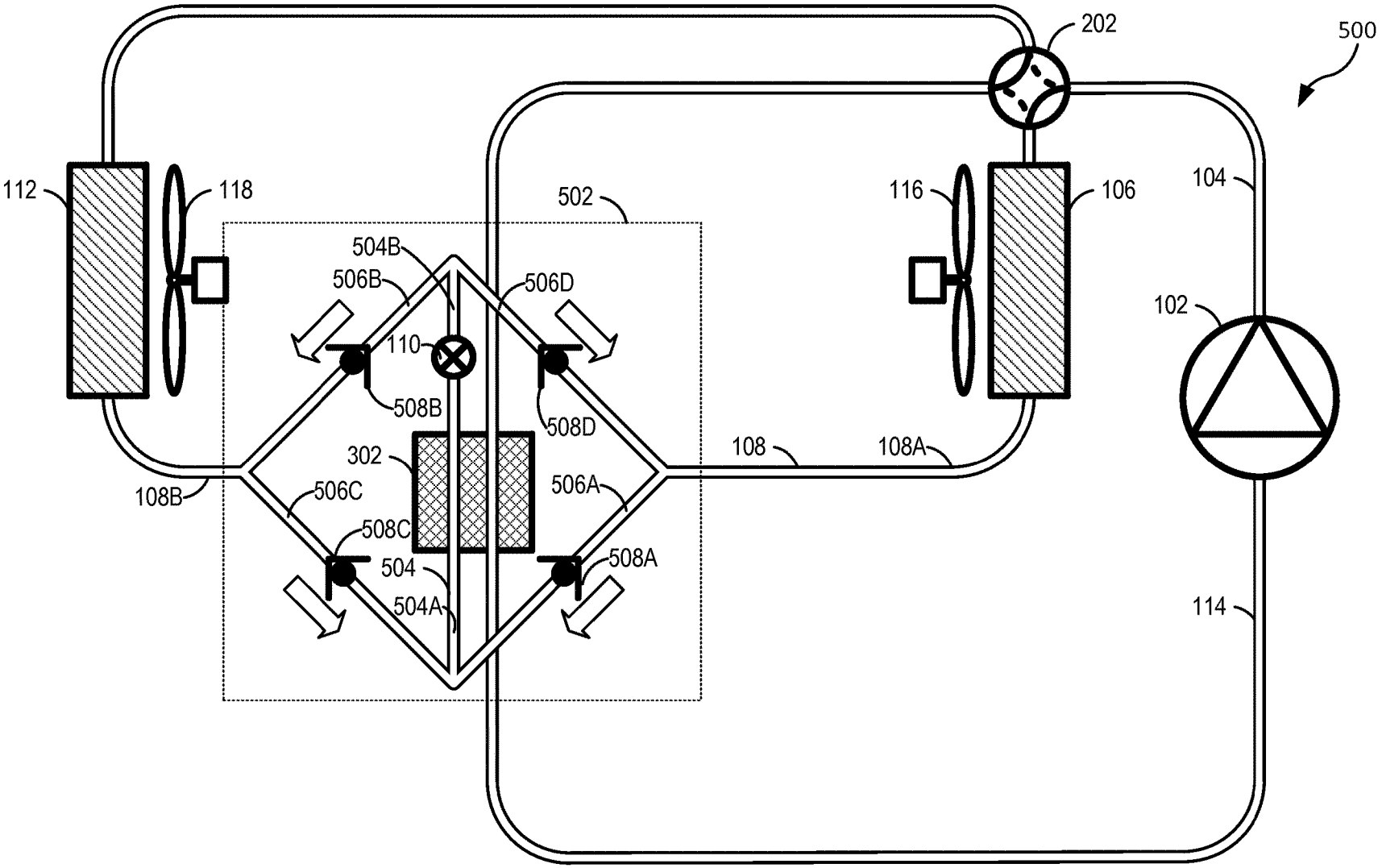
FIG. 5 depicts a reversible heat pump with cycle enhancement apparatus including a counterflow heat exchanger.

With reference to FIG. 5, depicted is a reversible heat pump 500 with counterflow heat exchanger 302 functional during both heating and air conditioning. Reversible heat pump 500 may have cycle enhancement apparatus 502 inserted in cool refrigerant line 108. Counterflow heat exchanger 302 and expansion device 110 may be part of cycle enhancement apparatus 502.

Cycle enhancement apparatus 502 may have cycle enhancement line 504. Cycle enhancement line 504 may have entrance portion 504A and exit portion 504B. Entrance portion 504A and exit portion 504B may be separated by counterflow heat exchanger 302 and expansion device 110.

Four refrigerant lines 506A-D may connect cycle enhancement line 504 to the rest of cool refrigerant line 108. Each refrigerant line 506A-D may have a corresponding one-way valve 508A-D. One-way valves 508A-D may permit refrigerant flow through lines 506A-D only in the direction of the adjacent arrows.

One-way valves 508A-D are shown as ball-and-seat valves. Refrigerant coming from the direction of the seat unseats the ball and flows through the valve. Refrigerant coming from the direction of the ball is obstructed because the ball is forced against the seat. Other types of one-way valves may be used instead of ball-and-seat valves.

Outdoor entrance line 506A may permit refrigerant to flow from outdoor side 108A of cool refrigerant line 108 to entrance portion 504A. Indoor exit line 506B may permit refrigerant to flow from exit portion 504B to indoor side 108B of cool refrigerant line 108. Indoor entrance line 506C may permit refrigerant to flow from indoor side 108B of cool refrigerant line 108 to entrance portion 504A. Outdoor exit line 506D may permit refrigerant to flow from exit portion 504B to outdoor side 108A of cool refrigerant line 108.

Cycle enhancement apparatus 502 solves the problem of reversible heat pump 400. During air conditioning, refrigerant may flow from outdoor side 108A of cool refrigerant line 108 through outdoor entrance line 506A, through cycle enhancement line 504 from entrance portion 504A to exit 504B, and then through indoor exit line 506B to indoor side 108B of cool refrigerant line 108. During heating, refrigerant may flow from indoor side 108B of cool refrigerant line 108 through indoor entrance line 506C, through cycle enhancement line 504 from entrance portion 504A to exit 504B, and then through outdoor exit line 506D to outdoor side 108A of cool refrigerant line 108. Suction line 114 may pass through counterflow heat exchanger 302 to absorb heat from refrigerant line 108, but not otherwise interact with cycle enhancement apparatus 502.

One-way valve 508D during air conditioning and one-way valve 508B during heating may prevent the refrigerant from flowing the wrong way as the refrigerant travels to entrance portion 504A. Refrigerant may pass through expansion device 110 before reaching exit portion 504B. The refrigerant at exit portion 504B may therefore be at a lower pressure than outdoor side 108A during air conditioning and at a lower pressure than indoor side 108B during heating. The refrigerant may therefore flow from exit portion 504B in the other direction. During air conditioning, the refrigerant may flow from exit portion 504 through one-way valve 508B, toward indoor side 108B. During heating, the refrigerant may flow through one-way valve 508D, toward outdoor side 108A.

Counterflow heat exchanger 302 is only one example of a one-way cycle enhancement. A number of other one-way cycle enhancements may be used in place of counterflow heat exchanger 302, as will be shown.

Figure 6:
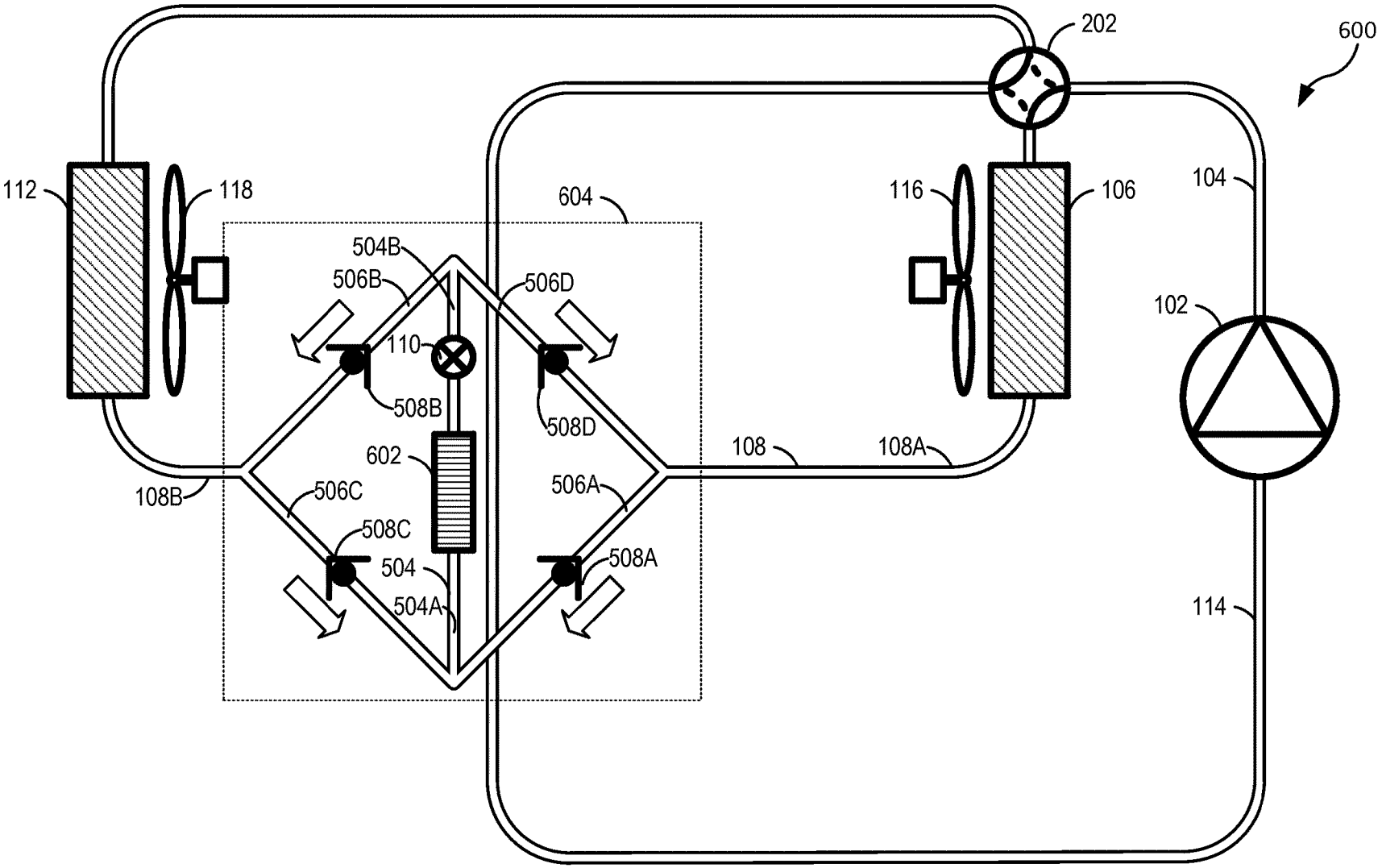
FIG. 6 depicts a reversible heat pump with a cycle enhancement apparatus including a thermoelectric subcooler.

With reference to FIG. 6, depicted is a reversible heat pump 600 with thermoelectric sub-cooler 602. Heat pump 600 may be similar to heat pump 500 except that its cycle enhancement apparatus 604 may have thermoelectric sub-cooler 602 in place of counterflow heat exchanger 302 and heat from the thermoelectric sub-cooler may be rejected to ambient air rather than to suction line 114.

Like counterflow heat exchanger 302, thermoelectric sub-cooler 602 is known in the art and is an example of a one-way cycle enhancement. Thermoelectric sub-cooler 602 may be a device which moves heat against a temperature grade in response to an application of DC electric power. The refrigerant flowing in line 504 may be cooled and the heat may be rejected to ambient air. The thermoelectric cooler may be constructed of several stacks of individual thermoelectric elements. The pairs in these individual elements may be arranged so that the ones with lower temperature lift capability are at the 504A entrance end and the elements with higher temperature lift capability are at the 504B exit end. The cooler refrigerant leaving exit portion 504B may improve the efficiency of the vapor compression cycle. The energy savings from the improved efficiency may exceed the energy cost of applying the DC electric power.

Thermoelectric sub-cooler 602 may be most efficient when refrigerant flows through it from entrance portion 504A to exit portion 504B, rather than vice versa. Cycle enhancement apparatus 604 allows heat pump 600 to reverse direction while still keeping refrigerant moving from entrance portion 504A to exit portion 504B. In FIG. 6, suction line 114 is shown passing behind cycle enhancement apparatus 604 for consistency with FIG. 5. Suction line 114 does not interact with cycle enhancement apparatus 604 in heat pump 600.

Figure 7:
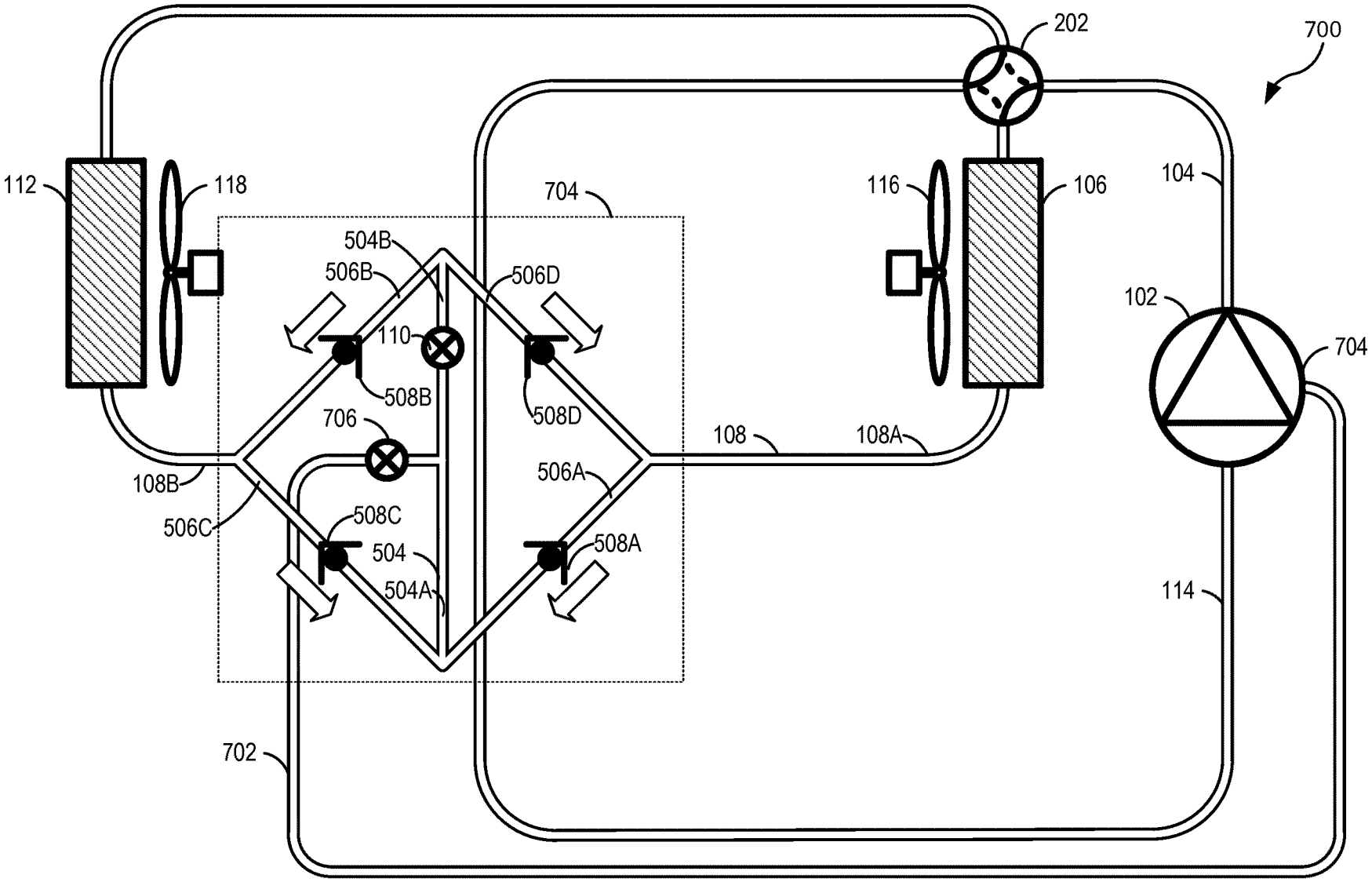
FIG. 7 depicts a reversible heat pump with a cycle enhancement apparatus including an injection line.

With reference to FIG. 7, depicted is a reversible heat pump 700 with injection line 702. Heat pump 700 may be similar to heat pump 500 except that, in place of counterflow heat exchanger 302, its cycle enhancement apparatus 706 may have injection line 702 running to injection port 704 of compressor 102, and heat may not be transferred between cycle enhancement line 504 and suction line 114.

Injection line 702 is known in the art and is an example of a one-way cycle enhancement. The refrigerant at injection port 704 may be at an intermediate pressure between the low pressure of the refrigerant in suction line 114 and the high pressure of the refrigerant in discharge line 104. However, the refrigerant at injection port 704 may be at a lower pressure than the refrigerant in cycle enhancement line 504. This pressure difference may cause refrigerant to flow from cycle enhancement line 504 through injection line 702 and into injection port 704. Injection line 702 may include metering valve 706, which limits the amount of refrigerant flow through injection line 702.

The circulation of refrigerant from cycle enhancement line 504 to compressor 102 may improve the efficiency of compressor 102. The refrigerant flow rate to the evaporator may be reduced, but this capacity loss may be outweighed by the improved efficiency of compressor 102. Injection line 702 is a one-way cycle enhancement because refrigerant must pass injection line 702 before expansion device 110. Cycle enhancement apparatus 706 allows heat pump 700 to reverse direction while still keeping refrigerant passing injection line 702 before expansion device 110. Suction line 114 does not interact with cycle enhancement apparatus 704 in heat pump 700.

Figure 8:
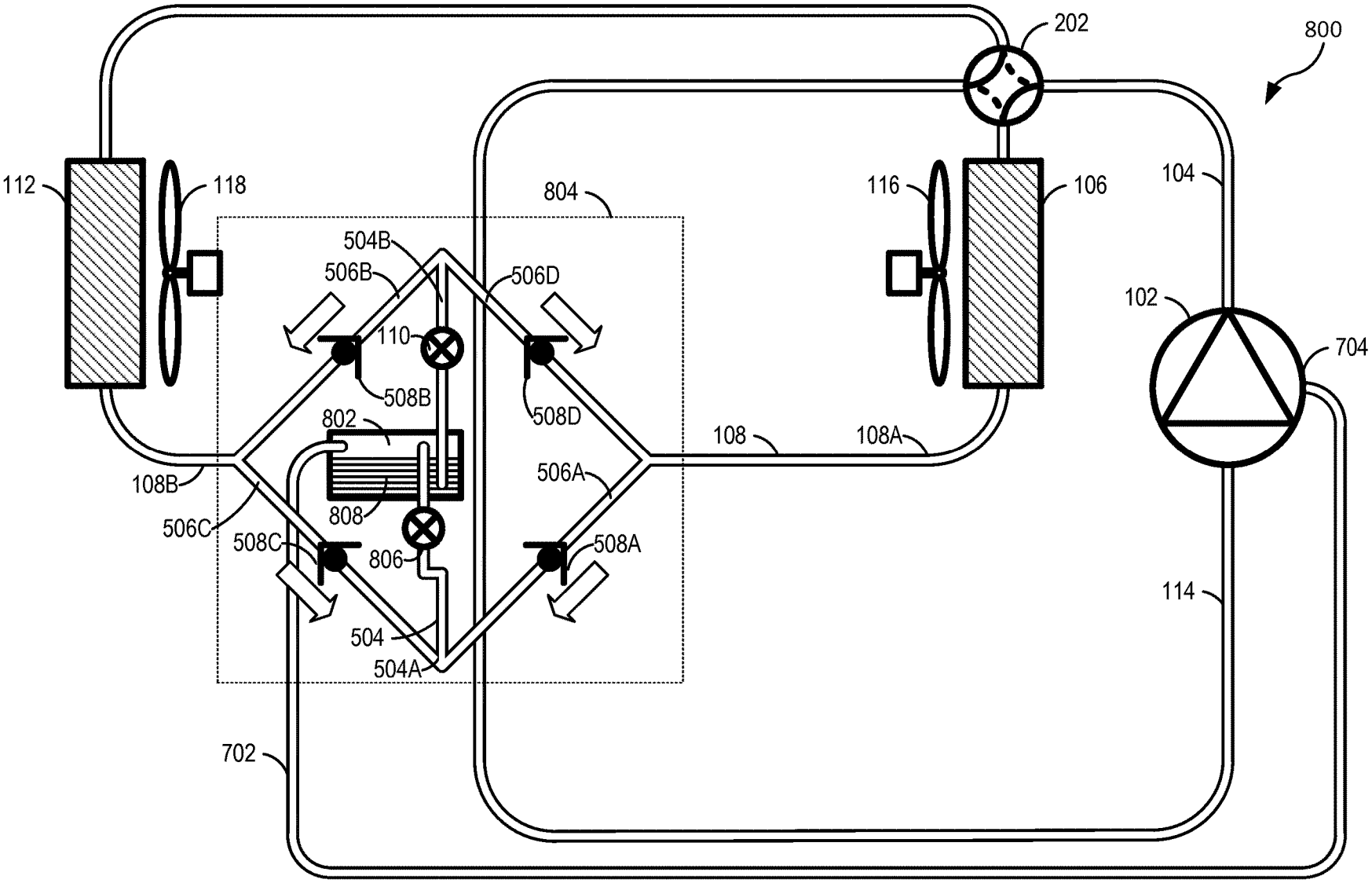
FIG. 8 depicts a reversible heat pump with a cycle enhancement apparatus including a Voorhees "multi-effect" flash tank.

With reference to FIG. 8, depicted is a reversible heat pump 800 with Voorhees "multi-effect" flash tank 802. Heat pump 800 may be similar to heat pump 700 except that its cycle enhancement apparatus 804 may have no metering valve 706 and may have flash tank 802 and flash tank valve 806.

Flash tank 802 is known in the art and is an example of a one-way cycle enhancement. Flash tank 802 may separate refrigerant vapor from refrigerant liquid after having been throttled by flash tank valve 806. Entrance portion 504A of cycle enhancement line 504 may end with an opening near the top of flash tank 802. Exit portion 504B of cycle enhancement line 504 may have an opening near the bottom of flash tank 802, below the end of entrance portion 504A. Liquid refrigerant 808 from entrance portion 504A may fall to the bottom of flash tank 802, where the refrigerant 808 may flow into exit portion 504B. Injection line 702 may have an opening in flash tank 802 near the top of flash tank 802, above exit portion 504B. Refrigerant vapor from entrance portion 504A may float above liquid refrigerant 808 and enter injection line 702.

Similar to heat pump 700, a pressure difference between injection port 704 and flash tank 802 may cause the refrigerant vapor to flow through injection line 702. The refrigerant vapor may be recirculated to compressor 102, where the refrigerant vapor may enter injection port 704. Liquid refrigerant in flash tank 802 may continue through cycle enhancement line 504, passing expansion device 110 and exit portion 504B. Flash tank valve 806 may reduce the pressure of refrigerant entering flash tank 802 to an intermediate pressure, between the higher pressure of refrigerant entering flash tank valve 806 and the lower evaporator pressure of the refrigerant leaving expansion device 110.

Similar to heat pump 700, bringing refrigerant from cycle enhancement line 502 to injection port 704 may improve the efficiency of compressor 102. The removal of higher energy refrigerant vapor from lower energy liquid refrigerant also may improve the efficiency of the vapor compression cycle after flash tank 802. The vapor compression cycle of heat pump 800 may be called an "economized cycle" due to flash tank 802.

Flash tank 802 may only function to separate vapor from liquid when refrigerant enters from entrance portion 504A. Cycle enhancement apparatus 706 allows heat pump 700 to reverse direction while the refrigerant still enters from entrance portion 504A. Suction line 114 does not interact with cycle enhancement apparatus 804 in heat pump 800.

Figure 9:
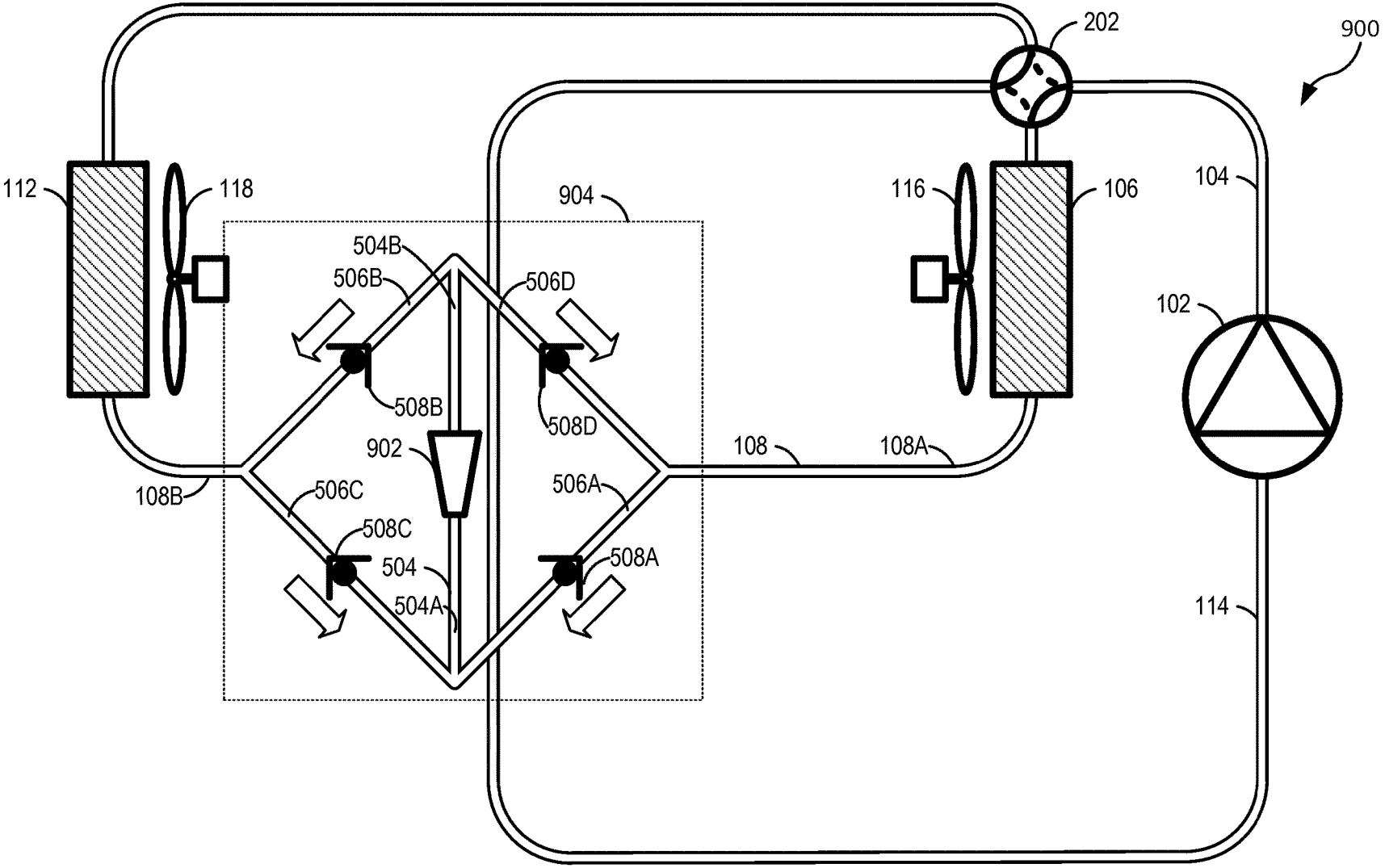
FIG. 9 depicts a reversible heat pump with a cycle enhancement apparatus including a work recovery expansion device.

With reference to FIG. 9, depicted is a reversible heat pump 900 with work recovery expansion device 902. Heat pump 900 may be similar to heat pump 500 except that its cycle enhancement apparatus 904 may have work recovery expansion device 902 in place of counterflow heat exchanger 302 and expansion device 110, and heat may not be transferred between line 504 and suction line 114.

Like counterflow heat exchanger 302, work recovery expansion device 902 is known in the art and is an example of a one-way cycle enhancement. Work recovery expansion device 902 may be a type of expansion device, reducing the pressure of refrigerant passing through it. Work recovery expansion device 902 may also use energy from the expansion of the refrigerant to perform work. For example, work recovery expansion device 902 may be a piston that turns a generator. The generator may produce 200-300 watts of power for compressor 102, reducing the amount of outside energy needed to run compressor 102. Suction line 114 does not interact with cycle enhancement apparatus 904 in heat pump 900.

Work recovery expansion device 902 may be a one-way cycle enhancement that does not function when refrigerant passes through it in one direction. Work recovery expansion device 902 may alternately be a one-way cycle enhancement that functions less efficiently when refrigerant passes through it in one direction. For example, work recovery expansion device 902 may be an axial turbine. The blades of the axial turbine may be optimized for one direction of refrigerant flow.

Figure 10:
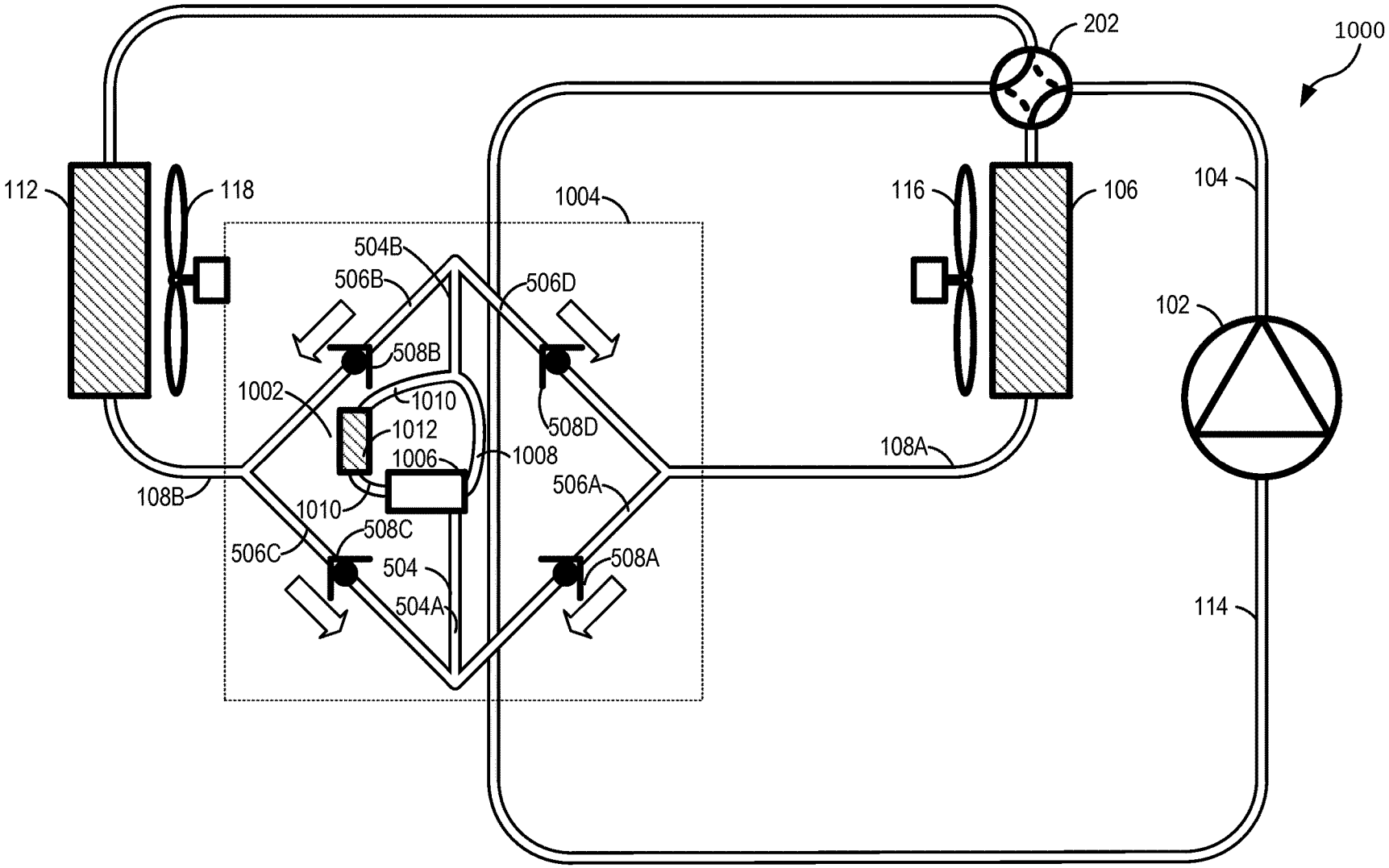
FIG. 10 depicts a reversible heat pump with a cycle enhancement apparatus including a vortex tube expander.

With reference to FIG. 10, depicted is a reversible heat pump 1000 with vortex tube expander 1002. Heat pump 1000 may be similar to heat pump 900 except that its cycle enhancement apparatus 1004 may have has vortex tube expander 1002 in place of work recovery expansion device 902.

Vortex tube expander 1002 is another example of a one-way cycle enhancement known in the art. Refrigerant may enter vortex tube 1006 tangentially from entrance portion 504A. The inlet to vortex tube 1006 may expand the refrigerant and reduce its pressure.

Vortex tube 1006 may separate refrigerant vapor, which has a high enthalpy, from liquid refrigerant. The liquid refrigerant may enter vortex tube liquid line 1008 and continue to exit portion 504B. The high enthalpy refrigerant vapor may flow through vortex tube vapor line 1010 to vortex tube heat exchanger 1012. Vortex tube heat exchanger 1012 may reduce the enthalpy of the superheated refrigerant vapor by rejecting heat to the ambient air. The lower enthalpy refrigerant vapor may continue through vortex tube vapor line 1010 to exit portion 504B, joining the liquid refrigerant stream.

Vortex tube expander 1002 may increase the energy absorbed in the evaporator since the enthalpy of the refrigerant vapor entering the evaporator has been reduced. For vortex tube expander 1002 to function, refrigerant may have to enter vortex tube 1006 from entrance portion 504A. Cycle enhancement apparatus 1004 allows heat pump 1000 to reverse direction while the refrigerant still enters vortex tube 1006 from entrance portion 504A. Suction line 114 does not interact with cycle enhancement apparatus 1004 in heat pump 1000.

Figure 11:
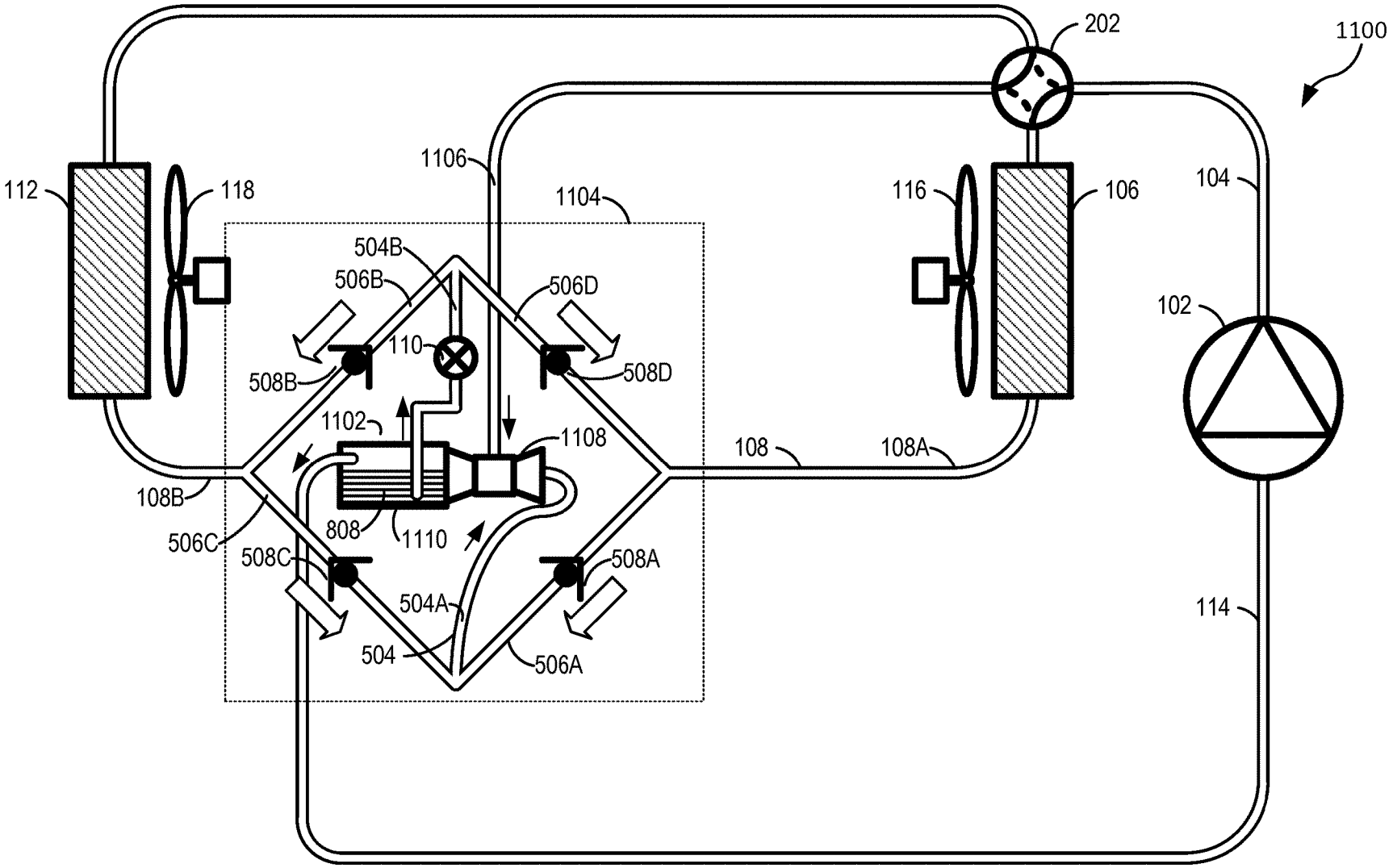
FIG. 11 depicts a reversible heat pump with a cycle enhancement apparatus including an ejector device.

With reference to FIG. 11, depicted is a reversible heat pump 1100 with ejector device 1102. Heat pump 1100 may have cycle enhancement apparatus 1104. Like the previously described cycle enhancement apparatuses, cycle enhancement apparatus 1104 may cause refrigerant to flow through cycle enhancement line 504 in only one direction, regardless of whether reversing device 202 is in an air conditioning configuration or a reversing configuration. Refrigerant may flow from entrance portion 504A, through ejector device 1102, and out exit portion 504B. However, refrigerant may also flow out of ejector device 1102 through suction line 114, and refrigerant may also flow into ejector device 1102 from evaporator line 1106. The arrows in FIG. 11 show the direction of flow in and out of ejector device 1102. Ejector device 1102 is another example of a one-way cycle enhancement known in the art.

Ejector device 1102 may act as an additional compressor, raising the pressure of the refrigerant in the vapor compression cycle and consequently reducing the energy needed by compressor 102. Ejector device 1102 may have ejector 1108 and separator 1110. Ejector 1108 may raise the pressure of refrigerant entering it, and then eject the refrigerant into separator 1110. Refrigerant may enter ejector 1108 both from entrance portion 504A and from evaporator line 1106.

Separator 1110 may separate refrigerant into refrigerant vapor and liquid refrigerant 808, similar to flash tank 802. Liquid refrigerant 808 may fall to the bottom of separator 1110. The exit portion 504B may have an opening near the bottom of separator 1110. Liquid refrigerant 808 may flow into the opening in exit portion 504B. The refrigerant vapor may float above liquid refrigerant 808. Suction line 114 may have an opening near the top of separator 1110, above exit portion 504B. The refrigerant vapor may flow into suction line 114.

In operation, refrigerant may flow through heat pump 1100 in the same manner as the previous heat pumps until the refrigerant reaches cycle enhancement line 504. From compressor 102, refrigerant may flow through discharge line 104, reversing device 202, and the gas cooler. During air conditioning, the gas cooler is outdoor heat exchanger 106. During heating, the gas cooler is indoor heat exchanger 112. From the gas cooler, the refrigerant may flow through refrigerant line 108 to cycle enhancement apparatus 1104. During air conditioning, the refrigerant may flow through outdoor entrance line 108 to entrance portion 504A of cycle enhancement line 504. During heating, the refrigerant may flow through indoor entrance line 108B to entrance portion 504A of cycle enhancement line 504.

From entrance portion 504A, the refrigerant may enter ejector 1108, where it combines with refrigerant coming from evaporator line 1106. Ejector 1108 may raise the pressure of the combined refrigerant to a pressure slightly above the evaporator pressure and eject the refrigerant into separator 1110. Separator 1110 may separate the refrigerant into refrigerant vapor and liquid refrigerant 808. The refrigerant vapor may flow through suction line 114 to compressor 102.

Liquid refrigerant 808 may flow through exit portion 504B of cycle enhancement line 502. As in preceding heat pumps, the refrigerant may expand at expansion device 110 and the lower pressure refrigerant may flow through either indoor exit line 506B, for air conditioning, or outdoor exit line 506D, for heating, to the evaporator. During air conditioning, the evaporator is indoor heat exchanger 112. During heating, the evaporator is outdoor heat exchanger 106.

From the evaporator, the refrigerant may flow to reversing device 202. In the preceding heat pumps, reversing device 202 would direct the refrigerant from the evaporator directly to suction line 114. In heat pump 1100, the refrigerant may be instead directed through evaporator line 1106 back to ejector 1108. The refrigerant may mix with refrigerant coming in from entrance portion 504A, and the cycle may continue.

Figure 12:
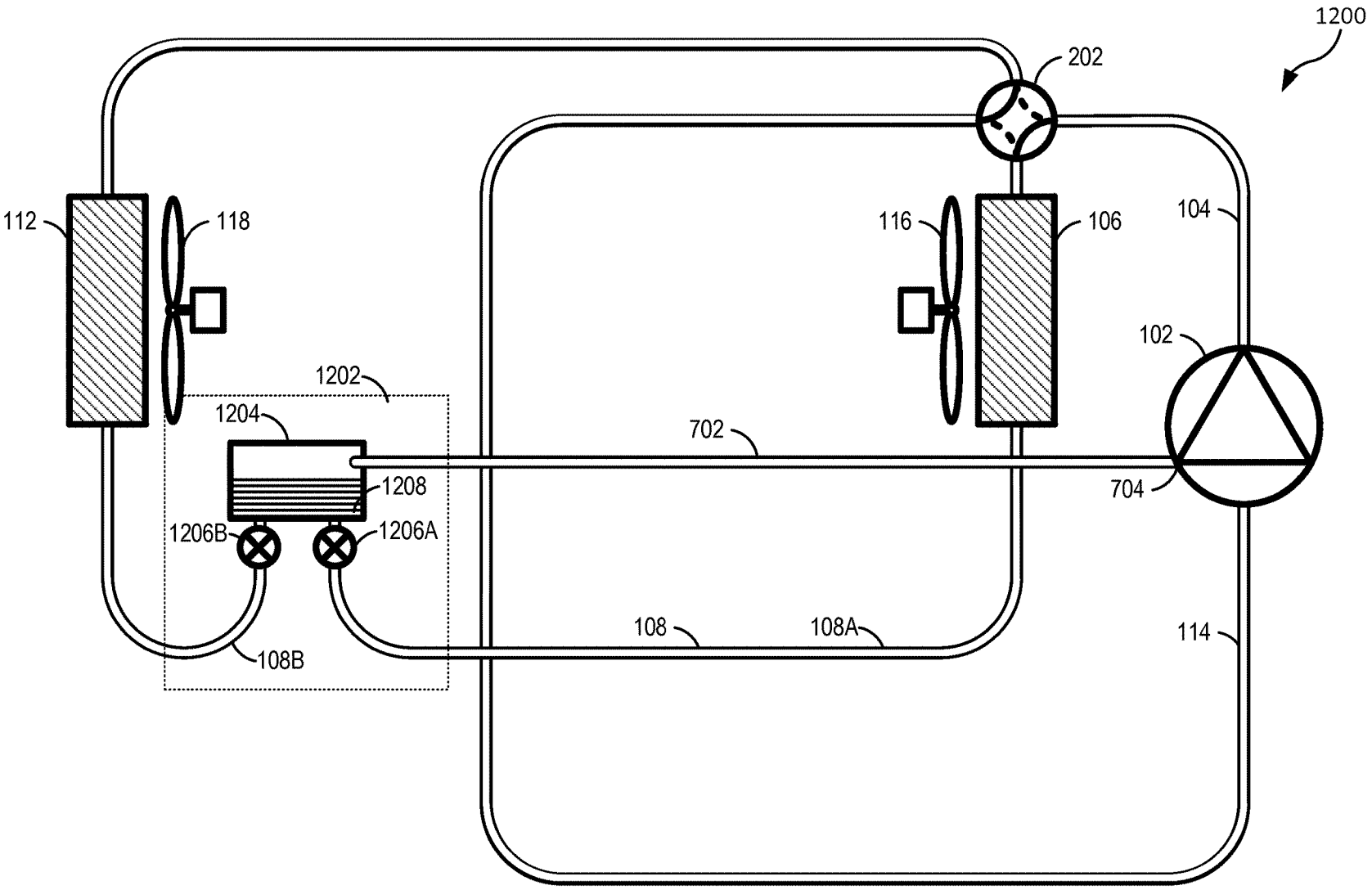
FIG. 12 depicts a reversible heat pump including a two-way Voorhees "multi-effect" flash tank.

With reference to FIG. 12, depicted is a reversible heat pump 1200 with two-way Voorhees "multi-effect" flash tank 1202. Heat pump 1200 may have cycle enhancement apparatus 1204. Unlike the previously disclosed one-way cycle enhancements, flash tank 1202 is a two-way cycle enhancement. Flash tank 1202 may function equally well regardless of whether refrigerant enters it from outdoor side 108A or indoor side 108B of cool refrigerant line 108.

The pressure in the flash tank 1202 may be maintained at an intermediate pressure suitable for supplying vapor to the compressor 102 injection port. This intermediate pressure may be lower than the pressure of the refrigerant entering cycle enhancement apparatus 1204 from cool refrigerant line 108. Expansion device 1206A may reduce the pressure of the refrigerant to the intermediate pressure if the refrigerant enters from outdoor side 108A. Expansion device 1206B may reduce the pressure of the refrigerant to the intermediate pressure if the refrigerant enters from outdoor side 108B. The intermediate pressure may be higher than the evaporator pressure of the refrigerant leaving cycle enhancement apparatus 1204. Expansion device 1206B may further reduce the pressure of the refrigerant to the evaporator pressure if the refrigerant leaves to indoor side 108B. Expansion device 1206A may further reduce the pressure of the refrigerant to the evaporator pressure if the refrigerant leaves to outdoor side 108A. Expansion devices 1206A and 1206B may be throttles.

Flash tank 1202 may separate liquid refrigerant 1208 from refrigerant vapor. Liquid refrigerant 1208 may fall to the bottom of flash tank 1202. During air conditioning, liquid refrigerant 1208 may leave flash tank 1202 through indoor side 108B, having been expanded to evaporator pressure by expansion device 1206B. During heating, liquid refrigerant 1208 may leave flash tank 1202 through outdoor side 108A, having been expanded to evaporator pressure by expansion device 1206A. Refrigerant vapor may float in flash tank 1202 above the liquid refrigerant. Injection line 702 may have an opening in flash tank 1202 above the openings for outdoor side 108A and indoor side 108B of liquid line 108. Injection line 702 may run to injection port 704 in compressor 102. As previously described, a pressure difference may draw the refrigerant vapor through injection line 702 into injection port 704. The refrigerant vapor may improve the efficiency of compressor 102.

It is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of various embodiments.

I claim:

1. A method comprising:

receiving refrigerant from a first heat exchanger;

preventing the refrigerant from flowing from the first heat exchanger through a first side exit line;

moving the refrigerant from the first heat exchanger through a first side entrance line;

preventing the refrigerant from flowing from the first side entrance line through a second side entrance line;

moving the refrigerant from the first side entrance line through a connection line, the connection line connecting both of the first side entrance line and the second side entrance line to both of the first side exit line and a second side exit line;

allowing heat transfer between the refrigerant moving through the connection line and a refrigerant portion moving through a suction line;

following the heat transfer, moving the refrigerant from the connection line through a second side exit line.

2. The method of claim 1, wherein the refrigerant comprises carbon dioxide.

3. The method of claim 1, further comprising moving the refrigerant from the second side exit line to a second heat exchanger.

4. An apparatus comprising:

a flash tank;

a first side expansion device connected to:

a first side of a refrigerant line; and the flask tank; and a second side expansion device connected to:

a second side of the refrigerant line; and the flash tank;

wherein the apparatus is configured to:

allow refrigerant to flow from the flash tank to the first side of the refrigerant line during a cooling mode; and allow the refrigerant to flow from the flash tank to the second side of the refrigerant line during a heating mode.

5. The apparatus of claim 4, wherein:

the first side of the refrigerant line is connected to a first heat exchanger; and the second side of the refrigerant line is connected to a second heat exchanger.

6. The apparatus of claim 4, further comprising an injection line connected to the flash tank and an injection port of a compressor.

7. The apparatus of claim 6, wherein the flash tank is configured to separate the refrigerant into a vapor refrigerant portion and a liquid refrigerant portion; and the apparatus is further configured to allow at least a portion of the vapor refrigerant portion to flow from the flash tank to the compressor via the injection line.

8. The apparatus of claim 7, wherein:

the refrigerant allowed to flow from the flash tank to the first side of the refrigerant line during the cooling mode comprises at least a portion of the liquid refrigerant portion; and the refrigerant allowed to flow from the flash tank to the second side of the refrigerant line during the heating mode comprises at least a portion of the liquid refrigerant portion.

* * * * *